US006988591B2

(12) United States Patent
Uranaka et al.

(10) Patent No.: US 6,988,591 B2
(45) Date of Patent: Jan. 24, 2006

(54) MINE TRANSPORTATION MANAGEMENT SYSTEM AND METHOD USING SEPARATE ORE VESSELS AND TRANSPORT VEHICLES MANAGED VIA COMMUNICATION SIGNALS

(75) Inventors: Kyouji Uranaka, Yokohama (JP); Satoshi Ogawa, Oyama (JP); Koichi Okamoto, Yokohama (JP); Takao Nagai, Yokohama (JP)

(73) Assignee: Komatsu Ltd., Tokyo (JP)

( * ) Notice: Subject to any disclaimer, the term of this patent is extended or adjusted under 35 U.S.C. 154(b) by 239 days.

(21) Appl. No.: 10/635,743

(22) Filed: Aug. 5, 2003

(65) Prior Publication Data

US 2004/0040792 A1 Mar. 4, 2004

(30) Foreign Application Priority Data

Sep. 4, 2002 (JP) ..... 2002-258989

(51) Int. Cl.
*B66B 1/28* (2006.01)

(52) U.S. Cl. ..... 187/247; 701/23; 701/24; 318/587

(58) Field of Classification Search ..... 187/247, 187/382; 318/562, 567, 565, 580, 568.12, 318/581, 587; 340/988–994, 436, 995.24, 340/995.27; 348/118, 119; 342/457; 701/1, 701/2, 23, 24, 36, 50, 200, 301
See application file for complete search history.

(56) References Cited

U.S. PATENT DOCUMENTS

| | | | | |
|---|---|---|---|---|
| 4,831,539 | A * | 5/1989 | Hagenbuch | 701/207 |
| 5,202,832 | A * | 4/1993 | Lisy | 701/24 |
| 5,586,030 | A * | 12/1996 | Kemner et al. | 701/23 |
| 5,646,844 | A * | 7/1997 | Gudat et al. | 701/208 |
| 5,925,081 | A * | 7/1999 | Hawkins et al. | 701/24 |
| 5,961,560 | A * | 10/1999 | Kemner | 701/24 |
| 6,543,983 | B1 * | 4/2003 | Felder et al. | 414/402 |
| 6,778,097 | B1 * | 8/2004 | Kajita et al. | 340/825.69 |
| 6,799,100 | B2 * | 9/2004 | Burns et al. | 701/25 |

FOREIGN PATENT DOCUMENTS

JP 2000-99143 A 4/2000

* cited by examiner

*Primary Examiner*—Jonathan Salata
(74) *Attorney, Agent, or Firm*—Frishauf, Holtz, Goodman & Chick, P.C.

(57) ABSTRACT

A mine transportation management system capable of reducing cost by reducing the number of transportation vehicles is provided. For this purpose, the system includes a plurality of self-propelled vehicles and a plurality of vessels each having a communication section, and each being identifiable, which are connectable to and separable from each other. A loading machine having a communication section, which loads an object into at least one of the vessels. A management center, which has a communication section, selects a vessel to be transported and selects a self-propelled vehicle for transporting the selected vessel based on a transportation demand signal from a processing facility, and transmits a transportation command signal to the selected self-propelled vehicle to connect to the selected vessel and to travel to the processing facility.

3 Claims, 4 Drawing Sheets

MINE TRANSPORTATION MANAGEMENT SYSTEM AND METHOD USING SEPARATE ORE VESSELS AND TRANSPORT VEHICLES MANAGED VIA COMMUNICATION SIGNALS

TECHNICAL FIELD

The present invention relates to a mine transportation management system and method.

BACKGROUND ART

In a mine, excavating machines such as hydraulic shovels perform excavation, and load excavated ore into dump trucks that are transporting vehicles, and the dump trucks carry the ore that is the product to a hopper of a processing facility and charges the ore into the hopper. In order to secure the production amount in such a mine, it is necessary to perform excavation and transport the ore that is the product, at a plurality of sites in the mine, and a number of dump trucks, which are the transporting vehicles, are used.

In a mine, various kinds of ore with various components are excavated, for example, in an iron mine, ore with high purity of iron, ore with low purity of iron, and the like are excavated at a plurality of sites. In the processing facility for crushing the ore and adjusting it to required components, how much ore of what components is required is indicated to the excavation site, and the dump truck transports the required ore and charges it into the hopper.

However, the dump trucks are expensive machines, and if a large number of them are used, the cost of the mine becomes extremely high. Accordingly, in order to increase the production amount, it is necessary to reduce the number of dump trucks as much as possible to reduce the cost of the mine, and carry the ore efficiently. In order to charge the necessary ore in the necessary amount in a good timing, it is necessary to always grasp the positions of the hydraulic shovels being the working machines, and the dump trucks. As an example, Japanese Patent Laid-open No. 2000-099143 discloses a system for communicating an operation position of a working machine to a management center, but sole use of this art is insufficient to carry ore being the product efficiently. Further, in a mine, dump trucks waiting for loading waits at an excavation site with an excavating machine, and it is desirable to reduce the waiting time for loading to enhance the efficiency, and increase the production amount of the mine.

SUMMARY OF THE INVENTION

The present invention is made in view of the above-described problems, and has its object to provide a mine transportation management system and method capable of reducing cost of a mine by reducing the number of transportation vehicles, transporting mine products in a good timing, and increasing a production amount of the mine by reducing a waiting time for loading of the transportation vehicles.

In order to attain the above-described object, a mine transportation management system according to the present invention includes: a plurality of self-propelled vehicles each having communication means and being identifiable; a plurality of vessels each having communication means and being identifiable; at least one loading machine having communication means and loading an object to be loaded into at least one vessel out of the plurality of vessels; a processing facility; and a management center having communication means; each of the plurality of self-propelled vehicles are connectable to and separable from each of the plurality of vessels; and the management center selects a vessel to be transported and selects a self-propelled vehicle for transporting the selected vessel from the plurality of self-propelled vehicles and the plurality of vessels, based on a transportation demand signal from the processing facility, and transmits a transportation command signal to the selected self-propelled vehicle, whereby the selected self-propelled vehicle connects to the selected vessel and travels to the processing facility.

According to the above constitution, the self-propelled vehicle transports the separable vessel, which is loaded with a necessary amount of necessary ore, in a good timing as necessary. Due to this, as compared with a prior art in which a number of dump trucks are prepared, only the necessary number of vessels, and only the necessary number of expensive self-propelled vehicles, which is the smaller number than the number of vessels, have to be prepared, and therefore the vehicle cost is sharply reduced. Further, the necessary kind and necessary amount of ore can be transported in a good timing, and therefore production in the mine can be efficiently carried out. In addition, the self-propelled vehicle is made to travel to the position of the vessel already loaded with the ore only when it is necessary, and therefore waiting time does not occur as in the prior art in which the dump truck waits for loading, thus making it possible to transport ore efficiently in the mine.

In the mine transportation management system: the management center may transmit a travel command signal to the selected self-propelled vehicle after the selected self-propelled vehicle discharges the loaded object into the processing facility, and may make the selected self-propelled vehicle travel to a designated position and separate the selected vessel therefrom. According to this constitution, just enough number of vessels can be placed in the site requiring the vessels.

In a mine transportation management method according to the present invention: a management center having communication means receives signals from a plurality of self-propelled vehicles each having communication means and being identifiable, signals from a plurality of vessels each having communication means, being connectable to and separable from said plurality of self-propelled vehicle and being identifiable, and a signal from at least one loading machine having communication means and loading an object to be loaded into at least one vessel out of the plurality of vessels; a vessel to be transported is selected from the plurality of vessels based on a transportation demand signal from a processing facility to which the loaded object is discharged; a self-propelled vehicle for transporting the selected vessel is selected from the plurality of self-propelled vehicles; and the selected self-propelled vehicle connects to the selected vessel and travels to the processing facility by a transportation command signal being transmitted to the selected self-propelled vehicle from the management center.

According to the above method, the same operational effects as in the above-described mine transportation management system can be obtained.

BEST MODE FOR CARRYING OUT THE INVENTION

Figure 1:
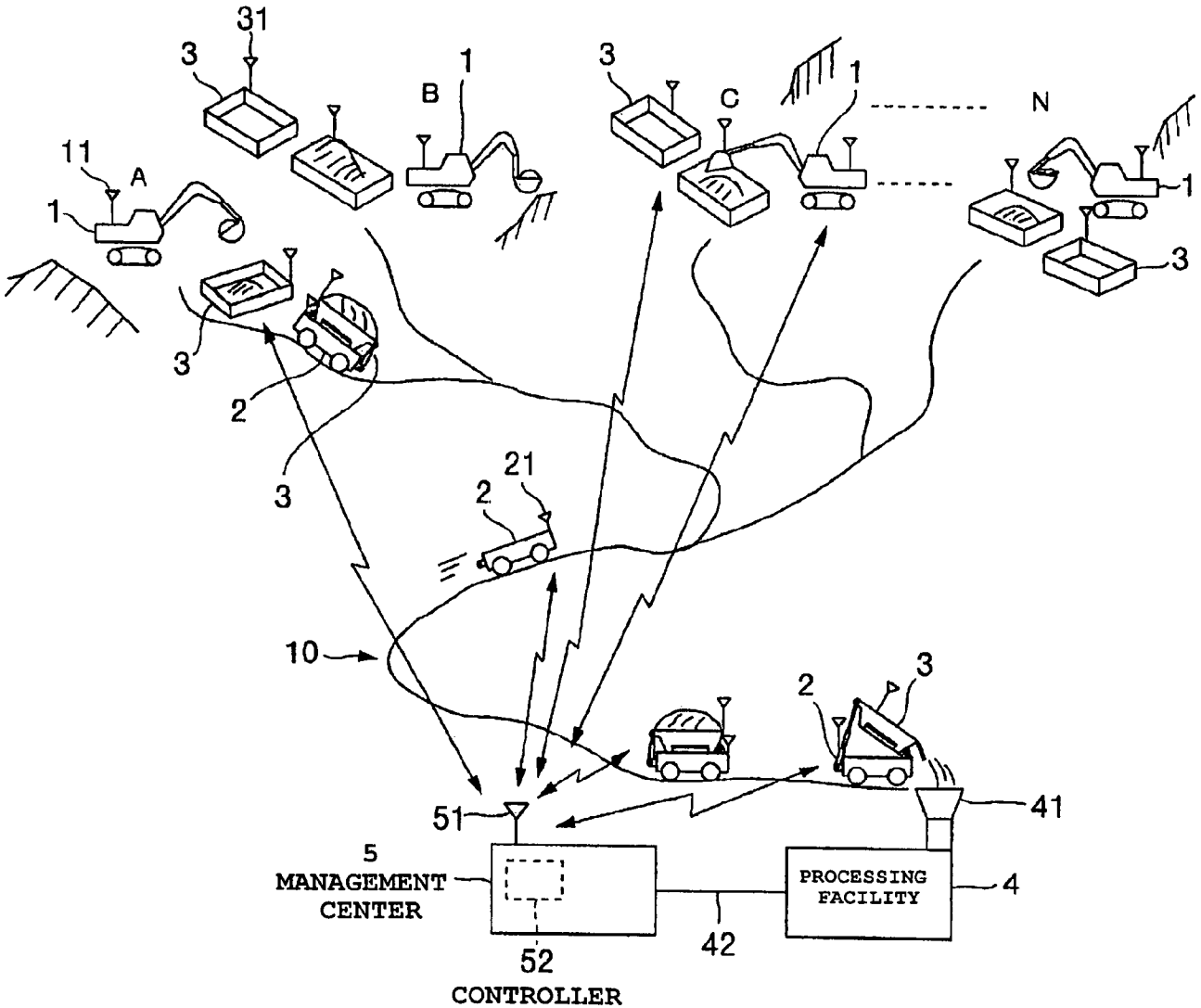
FIG. 1 is an explanatory view of a constitution of a mine transportation management system according to an embodiment of the present invention.

A preferred embodiment of a mine transportation management system according to the present invention will be described in detail below with reference to the drawings. FIG. 1 is an explanatory view of a constitution of a mine transportation management system 10. In FIG. 1, a plurality of hydraulic shovels 1 each of which is an example of an excavating and loading machine excavate ore in a site of a mine, and load the ore being an example of an object to be loaded into vessels 3 to perform loading. A plurality of vessels 3 are placed at excavating sites A, B, C, . . . , N in need of the vessels. A plurality of self-propelled vehicles 2 travel in the mine, some are loaded with the vessels 3 loaded with the excavated ore and others are loaded with the vessels 3 with empty load and they travel to predetermined sites. The self-propelled vehicle 2 discharges the ore to a hopper 41 of a processing facility 4 to crush the ore and adjust it to be of predetermined components. The processing facility 4 is connected to a management center 5 with a line 42 for performing communication. The management center 5 includes a controller 52 to perform data processing regarding the transportation of the mine.

The hydraulic shovel 1 includes a GPS (not shown) for detecting a present position, and always communicates the present position of the hydraulic shovel 1 to the management center 5 by excavator communication means 11 included in the hydraulic shovel 1. In this embodiment, the excavator communication means 11 is also loader communication means 11. The hydraulic shovel 1 always communicates i) an excavator number code such as, for example, E001, E002, . . . , E00N to identify a plurality of hydraulic shovels 1, ii) an operation condition code showing that the hydraulic shovel 1 is in the process of excavating operation, a loading operation to the vessel 3, an excavating and loading operation of repeating excavation and loading, or stopping an operation, and iii) a loading condition code showing how much and what kind of ore is loaded into the vessel 3 to the management center 5 by the excavator communication means 11. Communication to the management center 5 by the excavator communication means 11 may be made at a point of time when loading is finished, at a point of time when transmission is required by the management center 5, or at each predetermined time.

Figure 2:
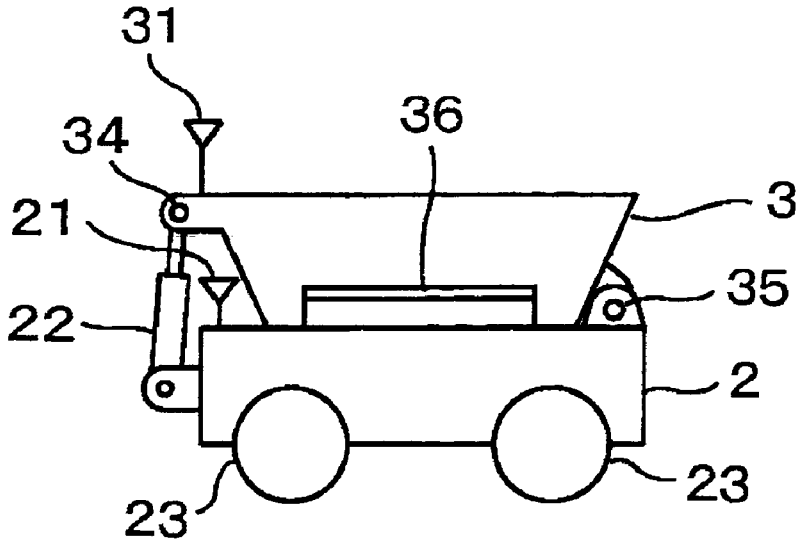
FIG. 2 is a view showing a state in which a self-propelled vehicle according to the embodiment is loaded with a vessel.

As shown in FIG. 2, the self-propelled vehicle 2 travels with the vessel 3 loaded thereon. The self-propelled vehicle 2 includes wheels 23 and 23 at a front and rear portion, and drives the wheels 23 and 23 by an engine and power transmission device (both are not shown), and steers with a steering device (not shown) and brakes with a braking device (not shown), thereby traveling on a traveling road inside the mine. The self-propelled vehicle 2 includes a hoist cylinder 22, an upper portion of the hoist cylinder 22 is attached to the vessel 3 with a connecting pin 34, and the rear portion of the self-propelled vehicle 2 and a rear portion of the vessel 3 are attached with a hinge pin 35. The self-propelled vehicle 2 includes a hydraulic device (not shown), and this hydraulic device contracts and extends the hoist cylinder 22.

As shown in FIG. 1 and FIG. 2, the self-propelled vehicle 2 includes a GPS (not shown) for detecting a present position, and always communicates the present position of the self-propelled vehicle 2 to the management center 5 by vehicle communication means 21. The self-propelled vehicle 2 always communicates a vehicle number code such as, for example, J001, J002, . . . , J00N to identify the vehicles, and a vehicle condition signal showing the present condition, for example, whether the vehicle is loaded with the vessel 3, whether it is traveling or not, or whether it is discharging the ore or not, to the management center 5 by the vehicle communication means 21. Communication to the management center 5 by the vehicle communication means 21 may be made at a point of time when transmission is required by the management center 5, or at each predetermined time. The self-propelled vehicle 2 may be an unmanned vehicle capable of autonomous traveling, or may be a manned vehicle operated by an operator.

The vessel 3 includes a GPS for detecting a present position, and always communicates the present position to the management center 5 by vessel communication means 31. The vessel 3 always communicates a vessel number code such as, for example, V001, V002, . . . , V00N for identification, and a vessel condition signal showing a present condition of the vessel 3, namely, whether it is connected to the self-propelled vehicle 2 or not, to the management center 5 by the vessel communication means 31. The communication to the management center 5 by the vessel communication means 31 may be made at a point of time when transmission is required by the management center 5, or may be at each predetermined time.

Figure 3:
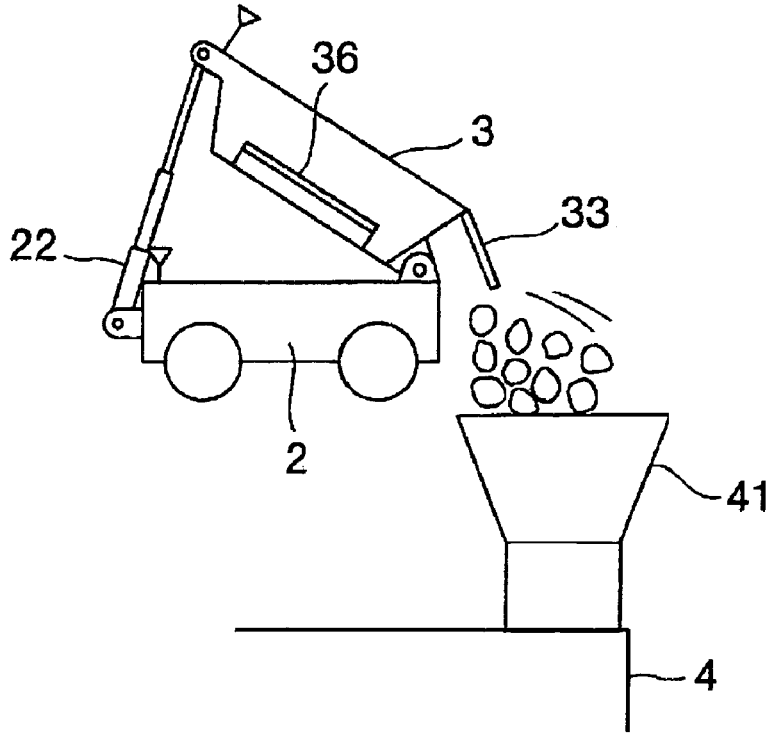
FIG. 3 is a view showing a state in which the self-propelled vehicle according to the embodiment performs a discharge operation.
Figure 4:
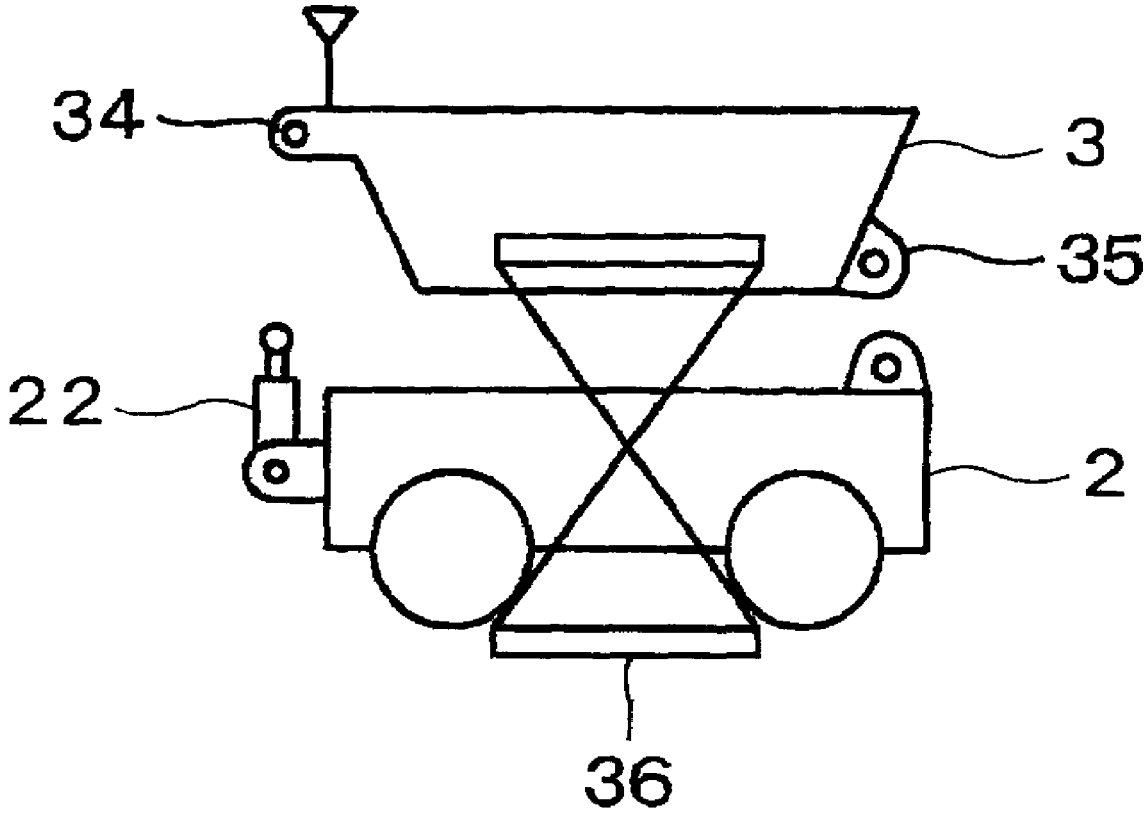
FIG. 4 is a view showing a state in which the self-propelled vehicle according to the embodiment is separated from the vessel.

As shown in FIG. 2 to FIG. 4, the vessel 3 includes a supporting leg 36 extending downward to stretch out. When the self-propelled vehicle 2 is loaded with the vessel 3, the supporting leg 36 is retracted. The supporting leg 36 can be retracted and stretched out by a power plant (not shown) included in the vessel 3. The supporting leg 36 can be retracted and stretched out at a remote site by operating the power plant according to a supporting leg driving signal transmitted from the management center 5 or the self-propelled vehicle 2. When the load is discharged, the hoist cylinder 22 is extended to tilt the vessel 3 and the ore being the load is discharged after a rear gate 33 at a rear portion of the vessel 3 is opened, as shown in FIG. 3.

The self-propelled vehicle 2 and the vessel 3 can be separated from each other. When they are separated, the hoist cylinder 22 is brought into a contracted state as in the state shown in FIG. 2, and thereafter, the supporting leg 36 is extended to be in contact with the ground to lift the vessel 3 slightly to establish the state in which a load exerted on the connecting pin 34 and the hinge pin 35 is eliminated. Then, the connecting pin 34 of a tip end of the hoist cylinder 22 and the vessel 3, and the hinge pin 35 connecting the self-propelled vehicle 2 and the rear portion of the vessel 3 are removed. Subsequently, as in the state shown in FIG. 4, the supporting leg 36 is extended to lift the vessel 3, and the vessel 3 is separated from the self-propelled vehicle 2. In this case, the hoist cylinder 22 is held at a predetermined position of the self-propelled vehicle 2 by holding means (not shown). When the self-propelled vehicle 2 and the vessel 3 are connected, the supporting leg 36 is retracted form the state shown in FIG. 4 to lower the vessel 3, the tip end of the hoist cylinder 22 and the vessel 3 are attached with the connecting pin 34, and the self-propelled vehicle 2 and the rear portion of the vessel 3 are attached with the hinge pin 35 to connect them.

Attaching and detaching the connecting pin 34 and the hinge pin 35 are performed by pin detaching and attaching means (not shown) included in the vessel 3. The pin detaching and attaching means can attach and detach the connecting pin 34 of the tip end of hoist cylinder 22 and the vessel 3, and the hinge pin 35 which connects the self-propelled vehicle 2 and the rear portion of the vessel 3 by being operated according to a pin attaching and detaching signal transmitted from the management center 5 or the self-propelled vehicle 2 via the vessel communication means 31 at a remote site.

The processing facility 4 includes ore processing equipment (not shown) such as a crusher and a sizing machine for processing the ore charged into the hopper 41. The processing facility 4 crushes the ore to adjust it to have predetermined components and size, transfers it to a stock yard (not shown) with transfer equipment (not shown) such as a belt conveyor, stores the product obtained by adjusting the ore, and ship it as necessary. The processing facility 4 communicates a transportation demand signal including the data such as the necessary kind of ore of necessary components (for example, iron ore with the specific gravity of 2.8 with high purity) and the necessary amount of ore (for example, 40 tons) in accordance with the production condition of the processed ore being the product to the management center 5 via the line 42. The transportation demand signal may include a time signal of the time at which the necessary ore becomes necessary (for example, at 10 a.m, 40 tons of iron ore with the specific gravity of 2.8 with high purity, and at 2 p.m., 30 tons of iron ore with the specific gravity of 2.5 with low purity), and may be communicated to the management center 5 in succession. The line 42 via which the processing facility 4 communicates with the management center 5 may be wired or wireless, or may be the one using a wireless telephone line or a wired telephone line.

The management center 5 includes management communication means 51, and always transmits and receives signals to and from a plurality of hydraulic shovels 1, a plurality of self-propelled vehicles 2 and a plurality of vessels 3. Namely, the management center 5 receives the present position of the hydraulic shovel 1, the excavator number code, the working condition code of the hydraulic shovel 1, and the loading condition code showing how much and what kind of ore is loaded on the vessel 3 from the excavator communication means 11. As a result, the received signal is processed by the controller 52 of the management center 5, and the management center 5 can know the present position of each of the plurality of hydraulic shovels 1, and the amount and the kind of ore loaded on each of the plurality of vessels 3. The management center 5 stores the aforementioned signal data received from the hydraulic shovels 1 in a storing device (not shown). The management center 5 stores the positions of the sites in the mine and the traveling course data in the storing device. The management center 5 may be integrated with the processing facility 4 to make the line 42 unnecessary, or may be a computer facility (not shown) itself. The reception of the management center 5 from the excavator communication means 11 may be performed as necessary, or may be performed at each predetermined time.

The management center 5 always receives the present positions of the vessels 3, the vessel number codes, and the vessel condition signals showing the present conditions of the vessels 3 from the plurality of vessels 3 by the vessel communication means 31. As a result, the management center 5 can know where each of plurality of vessels 3 is located now, and at which site each of the vessels 3 is located or which vessels 3 are loaded on the self-propelled vehicles 2. The management center 5 stores the aforementioned signal data received from the vessels 3 in the storing device. Accordingly, the management center 5 can grasp the present positions of the vessels 3 and the kind and amount of the ore loaded on each of the vessels 3 from the signal from the hydraulic shovels 1 and the signals from the vessels 3. The reception of the management center 5 from the vessel communication means 31 may be performed as necessary, or may be performed at each predetermined time.

The management center 5 always receives the present positions of the self-propelled vehicle 2, the vehicle number codes and the vehicle condition signals from the plurality of self-propelled vehicles 2 by the vehicle communication means 21. As a result, the management center 5 can know where each of the plurality of self-propelled vehicles 2 is located now, whether each of them is loaded with the vessel 3, whether the self-propelled vehicles 2 are separated from the vessels 3 and are single, and whether they are traveling, stopping or discharging the ore. The management center 5 stores the aforementioned signal data received from the self-propelled vehicles 2 in the storing device. The reception of the management center 5 from the vehicle communication means 21 may be performed as necessary, or may be performed at each predetermined time.

Since the management center 5 grasps the present positions of the hydraulic shovels 1, it can detect at which site the necessary kind of ore is located, and which hydraulic shovel 1 exists in that site from the ore data of the sites previously stored in the storing device. Accordingly, the management center 5 transmits the excavation and loading command signal to the selected hydraulic shovel 1 by the management communication means 51, and issues a command to excavate the ore and load the necessary amount of ore into the selected vessel 3 as necessary. The hydraulic shovel 1 receiving the excavation and loading command signal excavates the ore and loads the necessary amount of ore into the vessel 3.

The hydraulic shovel 1 may be a man operation machine, or unmanned operation machine. In the case of the manned operation machine, the operator previously loads the ore into the vessel 3 at the site, for example, and transmits the present position of the hydraulic shovel 1, the excavator number code, the operation condition code of the hydraulic shovel 1, and the loading condition code showing what kind of and how much ore is loaded on the vessel 3 from the hydraulic shovel 1 by the excavator communication means 11. Meanwhile, when the hydraulic shovel 1 is an unmanned operation machine, the kind of ore at the site where the hydraulic shovel 1 is placed is previously communicated to the hydraulic shovel 1 as the communication data from the management center 5. The hydraulic shovel 1 loads the ore into the vessel 3 at the site correspondingly to the command from the management center 5. When the loading is finished, the present position of the hydraulic shovel 1, the excavator number code, the working condition code of the hydraulic shovel 1, and the loading condition code showing what kind of and how much ore is loaded into the vessel 3 are transmitted from the hydraulic shovel 1 to the management center 5 by the excavator communication means 11.

When the management center 5 receives the transportation demand signal from the processing facility 4, it detects the position of the vessel 3 which is loaded with the necessary kind and amount of ore, and selects the self-propelled vehicle 2 capable of being loaded with the vessel 3 and transporting the vessel 3 to the processing facility 4, namely, the self-propelled vehicle 2 which is not loaded with the vessel 3. On this selection, it may be suitable to confirm that the vessel 3 detected according to the vessel condition signal is not loaded on the self-propelled vehicle 2 and select it. When a plurality of vessels 3 are detected, the one with the kind and amount of the loaded ore being close to the data of the transportation demand signal is selected. For example, when the transportation demand signal indicates 40 tons of iron ore with specific gravity of 2.6, the vessel 3 matched with the condition of the specific gravity of 2.55 to 2.65 and 35 tons to 45 tons in a predetermined error range is selected. When a plurality of self-propelled vehicles 2 are detected, the self-propelled vehicle 2, which takes the shortest time to load the vessel 3 and discharge the ore into the hopper 41 of the processing facility 4 that is calculated from the present position of the self-propelled vehicle 2, is selected.

The management center 5 transmits the transportation command signal to the selected self-propelled vehicle 2. The transmitted transportation command signal includes the present position of the selected vessel 3, and the vessel number code to identify the vessel 3. The self-propelled vehicle 2 receiving the transportation command signal goes to the position of the selected vessel 3, loads the vessel 3 thereon and connects to the vessel 3, travels to the position of the hopper 41 of the processing facility 4, and discharges the iron ore into the hopper 41.

When the self-propelled vehicle 2 finishes the discharge, it transmits the discharge completion signal to the management center 5. When the management center 5 receives the discharge completion signal, it selects the site to place the vessel 3, transmits the position of the selected site to the self-propelled vehicle 2, and transmits the travel command signal to the self-propelled vehicle 2. The self-propelled vehicle 2 receiving the travel command signal travels to the designated site, where it operates the pin attaching and detaching means correspondingly to the pin attaching and detaching signal transmitted from the management center 5 or the self-propelled vehicle 2 to separate the vessel 3 in accordance with the aforementioned method.

The separated vessel 3 retracts the supporting leg 36, and waits for loading of the ore by the hydraulic shovel 2. The separated vessel 3 transmits the vessel condition signal to the management center 5 via the vessel communication means 31 by detecting the condition of the pin attaching and detaching means. The separated vessel 3 transmits the present position of the vessel 3 to the management center 5 via the vessel communication means 31. The separated vessel 3 may wait loading of the ore by the hydraulic shovel 2 with the supporting leg 36 being stretched out as necessary.

When the management center 5 receives the transportation demand signal including the signal indicating the time when the necessary ore is needed from the processing facility 4, the management center 5 may store the data of the vessel 3 and the self-propelled vehicle 3 selected correspondingly to the necessary time with the calculated scheduled time for transmission of the transportation command signal. The management center 5 automatically creates the time schedule, and may transmit the transportation command signal to the self-propelled vehicle 2 in succession correspondingly to the time schedule. Consequently, successively efficient transportation becomes possible. The scheduled time for transmission may be one or plural.

Figure 5:
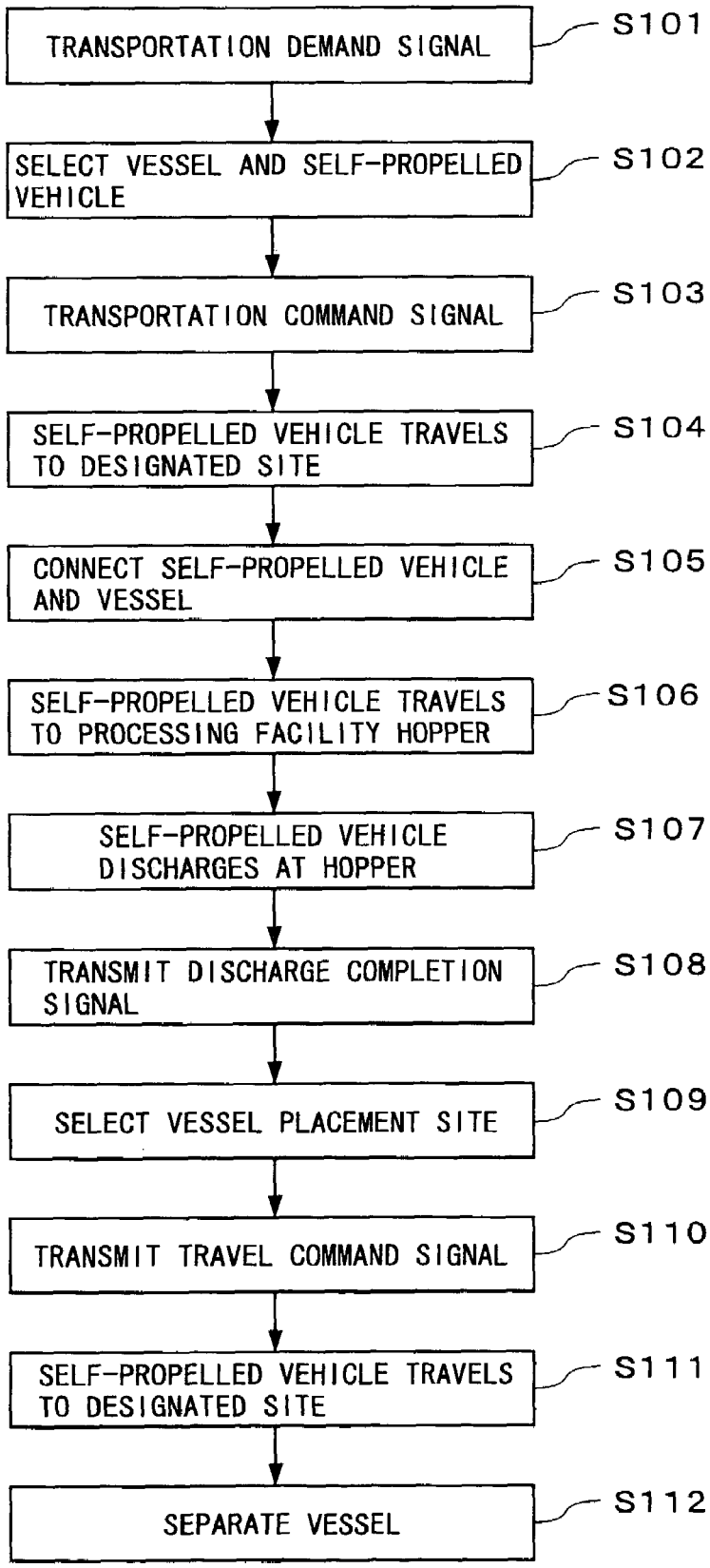
FIG. 5 is a flowchart showing an operation of the mine transportation management system according to the embodiment.

Next, an operation of the mine transportation management system 10 will be explained in accordance with a flowchart shown in FIG. 5. In step S101, the processing facility 4 communicates the transportation demand signal including the ore of a necessary component (for example, the iron ore with the specific gravity of 2.8 with high purity) and the necessary amount of ore (for example, 40 tons) to the management center 5 via the line 42 in accordance with the production condition of the product. In step S102, the management center 5 selects the vessel 3 loaded with the necessary kind and amount of ore based on the transportation demand signal from the processing facility 4, and also selects the most suitable self-propelled vehicle 2 for transportation. In step S103, the management center 5 transmits the transportation command signal to the selected self-propelled vehicle 2. In step S104, the self-propelled vehicle 2 receiving the transportation command signal travels to the position of the selected vessel 3. In step S105, the self-propelled vehicle 2 is loaded with the vessel 3 and connects it thereto.

In step S106, the self-propelled vehicle 2 travels to the position of the hopper 41 of the processing facility 4. In step S107, the self-propelled vehicle 2 discharges the ore to the hopper 41. In step S108, when the self-propelled vehicle 2 finishes the discharge, it transmits the discharge completion signal to the management center 5. In step S109, when the management center 5 receives the discharge completion signal, it selects the site where the vessel 3 is to be placed. In step S110, the management center 5 transmits the position of the selected site to the self-propelled vehicle 2, and transmits the travel command signal to the self-propelled vehicle 2. In step S111, the self-propelled vehicle 2 receiving the travel command signal travels to the designated site. In step S112, at the site which the self-propelled vehicle 2 travels to reach, the self-propelled vehicle 2 operates the pin attaching and detaching means to separate the vessel 3 in accordance with the pin attaching and detaching signal transmitted from the management center 5 or the self-propelled vehicle 2.

As described in detail thus far, according to the mine transportation management system 10 of the present invention, the self-propelled vehicle 2 is loaded with the vessel 3 and transports a necessary amount of necessary ore at a necessary time. Consequently, as compared with the prior art in which a number of dump trucks are prepared, only a necessary number of vessels 3 and a necessary number of self-propelled vehicles 2 to transport the vessels 3 have to prepared. For example, as compared with the prior art requiring 50 dump trucks, the present invention only needs to prepare 50 of the vessels 3 and 30 of the self-propelled vehicles 2 necessary to transport the vessels 3 as necessary, and therefore the vehicle cost is sharply reduced.

Since the necessary kind and amount of ore can be transported in a good timing, the production in the mine can be performed efficiently. Since the self-propelled vehicles 2 are made to travel to the positions of the vessels 3 already loaded with ore as necessary, waiting time does not occur as in the prior art in which the dump trucks wait for loading, and thus transportation of ore can be efficiently carried out.

The mine to which the mine transportation management system 10 of the present invention can be applied may be metal mines such as an iron mine, a copper mine, a gold mine, and a diamond mine, or nonmetal mines. As the mine, those for producing earth and sand, sand, rocks and stones, and gravel are included, and it may be the site in which excavated earth is simply moved. The processing facility 4 is not only the one for processing ore, but may be an earth-moving machine when the excavated earth is back-filled. The excavating and loading machine is not limited to the hydraulic shovel 1, and it may be a wheel loader, or may be an ordinary loading machine, which does not excavate but only performs loading.

As the means for detecting the present position, it is not limited to the GPS, but it may be the means using a gyro capable of detecting the present position, or the means for detecting the present position in accordance with the signal from an antenna of the specified position. The excavator communication means 11, the vehicle communication means 21, the vessel communication means 31 and the management communication means 51 may be the ones using the wireless telephone lines.

What is claimed is:

1. A mine transportation management system, comprising:

a plurality of individually identifiable self-propelled vehicles each including a communication section;

a plurality of individually identifiable vessels each including a communication section;

at least one loading machine which includes a communication section and which loads an object into at least one vessel of said plurality of vessels;

a processing facility; and a management center including a communication section;

wherein each of said plurality of self-propelled vehicles is connectable to and separable from each of said plurality of vessels; and wherein said management center selects a vessel to be transported and selects a self-propelled vehicle for transporting said selected vessel, based on a transportation demand signal from said processing facility, and transmits a transportation command signal to said selected self-propelled vehicle, such that said selected self-propelled vehicle connects to said selected vessel and travels to said processing facility.

2. The mine transportation management system according to claim 1, wherein said management center transmits a travel command signal to said selected self-propelled vehicle after said selected self-propelled vehicle discharges the loaded object in the selected vessel to said processing facility, to cause said selected self-propelled vehicle to travel to a designated position and separate said selected vessel therefrom.

3. A mine transportation management method, wherein a management center having a communication section receives; (i) signals from a plurality of individually identifiable self-propelled vehicles, each of which includes a communication section, (ii) signals from a plurality of individually identifiable vessels, each of which includes a communication and is connectable to and separable from each of said plurality of self-propelled vehicles, and (iii) a signal from at least one loading machine which includes a communication section and which loads an object into at least one vessel of said plurality of vessels;

selecting a vessel to be transported from said plurality of vessels based on a transportation demand signal from a processing facility to which the loaded object is to be discharged;

selecting a self-propelled vehicle for transporting said selected vessel from said plurality of self-propelled vehicles; and transmitting a transportation command signal from said management center to said selected self-propelled vehicle to cause said selected self-propelled vehicle to connect to said selected vessel and to travel to said processing facility.

* * * * *